US005890620A

United States Patent [19]

Belcastro

[11] Patent Number: 5,890,620

[45] Date of Patent: Apr. 6, 1999

[54] AUTOMATICALLY SEALING CUP

[76] Inventor: Domenic Belcastro, 32011 Di Stefano Ct., Fraser, Mich. 48026

[21] Appl. No.: 911,534

[22] Filed: Aug. 14, 1997

[51] Int. Cl.[6] ..... B65D 39/08

[52] U.S. Cl. ..... 220/714; 220/717; 220/203.19; 220/203.11; 220/203.29; 215/309; 215/11.5; 215/11.4

[58] Field of Search ..... 220/714, 717, 220/718, 203.11, 203.19, 203.29, 703, 711; 215/11.5, 11.4, 338, 309

[56] References Cited

U.S. PATENT DOCUMENTS

| | | |
|---|---|---|
| 2,107,442 | 2/1938 | Hughes . |
| 2,447,870 | 8/1948 | Polcyn . |
| 2,608,841 | 9/1952 | Rice . |
| 2,753,068 | 7/1956 | Robinson . |
| 2,876,772 | 3/1959 | Witz . |
| 3,915,331 | 10/1975 | Chenault . |
| 3,967,748 | 7/1976 | Albert . |
| 4,135,513 | 1/1979 | Arisland . |
| 4,712,704 | 12/1987 | Ramsey et al. . |
| 4,946,062 | 8/1990 | Coy . |
| 5,079,013 | 1/1992 | Belanger . |
| 5,150,815 | 9/1992 | Saklad . |
| 5,169,016 | 12/1992 | Hinz, Jr. . |
| 5,273,172 | 12/1993 | Rossbach et al. . |
| 5,339,982 | 8/1994 | Tardie . |
| 5,465,866 | 11/1995 | Belcastro . |
| 5,542,670 | 8/1996 | Morano . |
| 5,706,973 | 1/1998 | Robbins, III et al. . |

OTHER PUBLICATIONS

Manually Sealable Cup Product of Glenn Troudeau, Montreal Canada J4B5Y1. Date Unknown, But on Sale Before Jul. 11, 1994.

Sip–A–Mug Product Sold by Arbor Drugs, Inc., Troy MI 48084 Date Unknown, but Was Advertised in a Circular on or About Jul. 1994, p. 24.

Sports Bottle Product of Countryside Products, Pickerington, OH 43147 Date Unknown, But Was on Sale Before Jul. 11, 1994.

"Competition in Sippy–Cup Market Spills Into Court" Wall Street Journal, Aug. 19, 1997, pp. B1–B8.

*Primary Examiner*—Stephen Castellano
*Attorney, Agent, or Firm*—Peter D. Keefe

[57] ABSTRACT

A self-sealing drinking container includes a cup body having a hollow interior for holding and dispensing a liquid, and a lid assembly which fits sealingly on the cup body. The lid assembly has an inlet passage with an inlet valve in communication therewith, and an outlet passage with an outlet valve in communication therewith, each of the valves including a resiliently flexible diaphragm member. In a preferred embodiment, each of the inlet and outlet valves includes a cage having an open top and an open bottom to allow fluid passage therethrough, the cage having a seat formed therein for receiving a diaphragm member. The diaphragm member is located seatably into the seat so as to selectively seal thereagainst and thereby prevent fluid flow therepast. A locator post in each cage centrally abuts the diaphragm member thereof to ensure its seating. A predetermined level of fluid pressure differential across each diaphragm member causes, respectively, the diaphragm members to concavely bend (or flex) away from their respective seat and thereby allow fluid flow through the valves. However, below the respective predetermined levels of fluid pressure differential, the diaphragm members sealingly abut their respective seats, thereby sealing the cup.

15 Claims, 3 Drawing Sheets

AUTOMATICALLY SEALING CUP

BACKGROUND OF THE INVENTION

1. Field of the Invention

The present invention relates to a sealable cup for holding and dispensing drinkable fluids. More particularly, the present invention relates to such a cup which seals automatically when not in use, to prevent spillage of fluids therefrom. Still more particularly, the present invention relates to such a cup having simplified and sanitary valve members for regulating fluid flow.

2. Description of the Background Art

Cups are widely used for drinking liquids, usually having an open mouth. Travel mugs and some other spill-resistant cups come with lids or caps for the mouth to resist spillage of the cup contents. In addition, sports bottles are often provided with a screw-on lid having a built-in straw, and a cap for sealing the end of the straw. Some of these sports bottles also have a manually operated pop-up vent which is sealed when pushed down and open when pushed up. These sports bottles still suffer from the fact that they will empty their contents in the event the bottle is tipped sideways, unless, fortuitously, the straw had been previously manually capped, the vent had been previously manually pushed down, and the fit between the aperture in the lid and the straw was truly sealing.

One type of commercially available cup for use by anyone, and particularly well suited for small children, includes a cup body and a lid which fits sealingly on to the cup body, with a drinking spout incorporated into the lid. Some self-sealing spill-resistant cups are known and commercially available.

U.S. Pat. No. 5,079,013 to Belanger discloses a dripless liquid container for training and feeding a young person. The container of Belanger has a cup-shaped liquid housing and a lid which fits sealingly on the housing. The lid has a spout for drinking out of, with an outlet formed in the lid in fluid communication with the spout. A spring-loaded self-sealing outlet valve is provided in fluid communication with the outlet. The lid also has an air inlet formed therein which admits air to replace the volume of fluid removed from the housing, with a spring-loaded self-sealing air inlet control valve in communication with the air inlet.

U.S. Pat. No. 5,465,866 to Belcastro discloses a spill-resistant drinking cup with a built in tube for drinking therefrom. The cup of Belcastro has a cup body and a lid which is sealingly and releasably connected to the cup body The lid includes a pivotable handle, and the position of the handle determines pinching or unpinching of the tube, and, consequently, sealed and open states, respectively, of the cup. A biasing member, associated with the lid, automatically biases the handle into the sealing position when pressure is not being applied to the handle. Compressing the handle also opens an air inlet for equalizing pressure inside and outside the cup. Belcastro is also the inventor of the present invention.

A need still exists in the art for an automatically sealing cup of the Belanger type, using improved seals on the inlet and outlet thereof Preferably, the use of spring-loaded valves could be avoided for reasons of simplicity, maintenance of sanitary conditions, ease of manufacture, and cost containment.

SUMMARY OF THE INVENTION

The present invention provides an improved self-sealing drinking container of the Belanger type having a liquid housing with a lid, the lid having improved self-sealing inlet and outlet valves, which include disc-shaped flexibly resilient diaphragm members.

In a preferred embodiment of the present invention, a self-sealing drinking container includes a cup body having a hollow interior for holding and dispensing a liquid, and a lid assembly which fits sealingly onto the cup body. The lid assembly has an inlet passage with an inlet valve in communication therewith, and also has an outlet passage with an outlet valve in communication therewith. In the preferred embodiment, each of the inlet and outlet valves includes a cage having an open top and an open bottom to allow fluid to pass therethrough, the cage having a seat formed therein. Each valve also includes a disc-shaped flexibly resilient diaphragm member for placement in the seat to selectively prevent fluid flow therepast, and a locating member centrally disposed in the cage for abutting centrally against the diaphragm member.

In operation, lowered pressure by sucking at the outlet passage results in the diaphragm member of the outlet valve concavely bending out of its sealingly seated position, thereby allowing liquid to flow therepast and out of the cup. As liquid dispenses, air pressure inside the cup lowers relative to the outside air pressure, causing a pressure differential wherein the diaphragm member of the inlet valve concavely bends out of its sealingly seated position, thereby allowing air to flow therepast into the cup. Conversely, equalized pressure across the diaphragm members results in the inherent resiliency of the diaphragm members sealingly abutting their respective seat, thereby preventing fluid flow through the respective valves.

Accordingly, it is an object of the present invention to provide an automatically sealing cup for use by infants and small children having improved valve members which particularly provide sanitary operation and are inexpensive and easily maintained.

It is another object of the present invention to provide an automatically sealing cup having an inlet valve and an outlet valve, wherein the inlet and outlet valves operate on a flexibly resilient diaphragm principle.

Other objects, features, advantages, and benefits of the present invention will become apparent from a review of the following specification.

DETAILED DESCRIPTION OF THE PREFERRED EMBODIMENT

Figure 1:
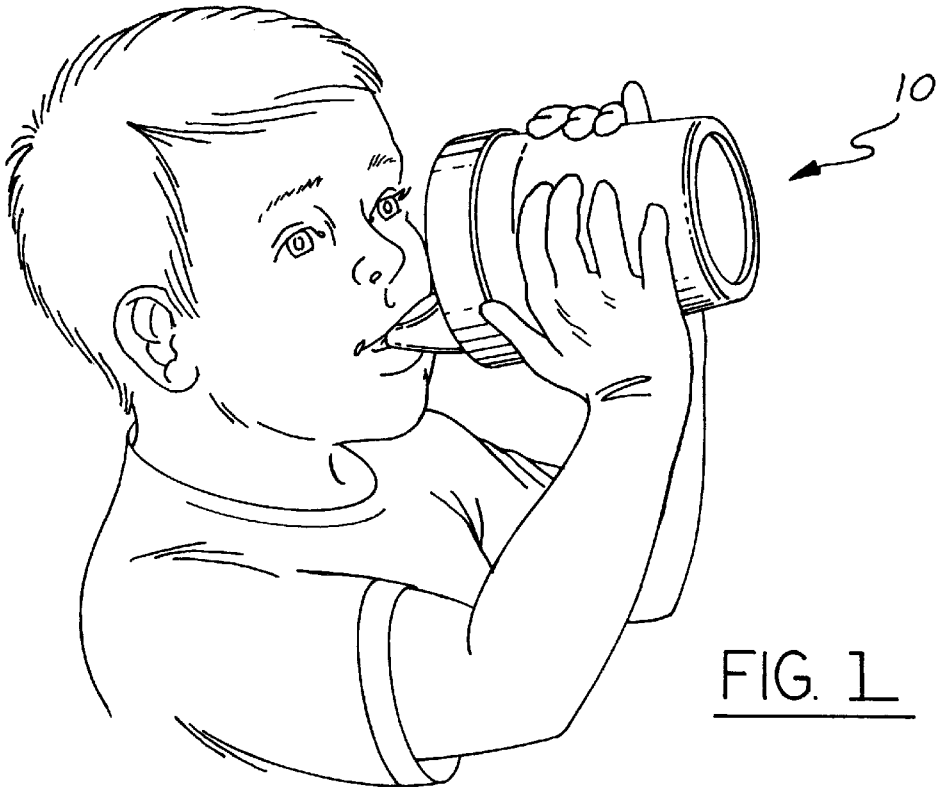
FIG. 1 is a perspective view of a young person drinking from an automatically sealing cup in accordance with the present invention.
Figure 2:
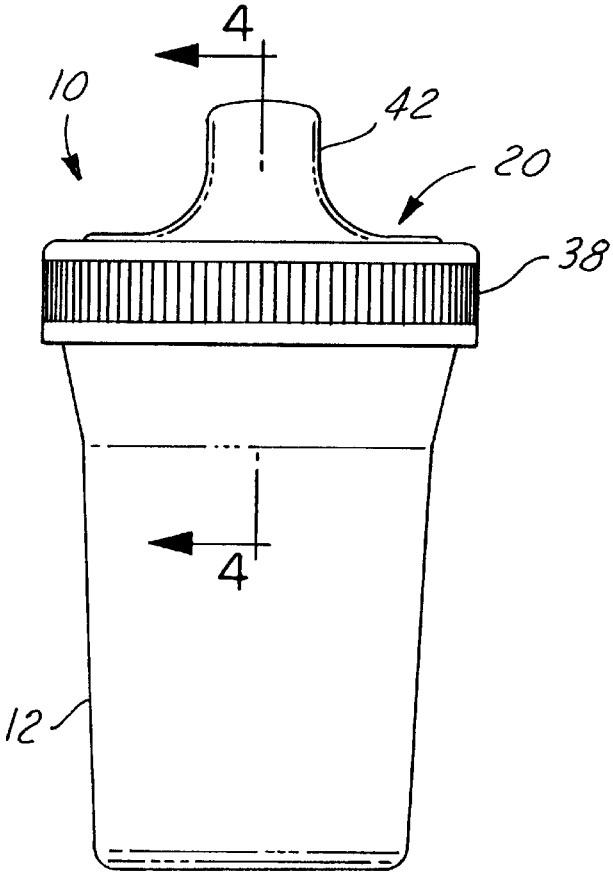
FIG. 2 is a side plan view of the automatically sealing cup in accordance with the present invention.
Figure 3:
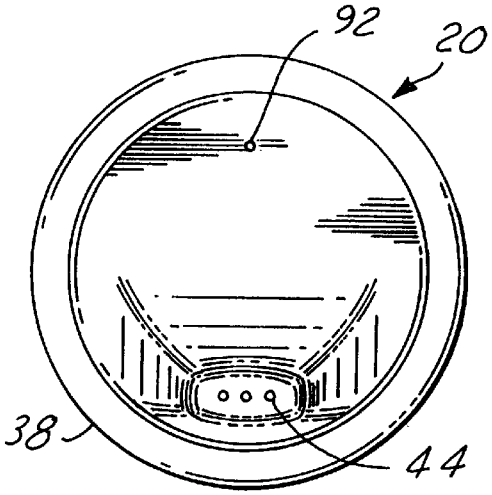
FIG. 3 is a top plan view of the automatically sealing cup in accordance with the present invention.

Referring now to the Drawings, an automatically sealing cup, for use by anyone, including for example an infant or young child, is shown generally at 10. The cup 10 includes a cup body 12 having a hollow interior 14 (see FIG. 4) for holding a drinkable liquid L such as, e.g., water, milk or juice therein. The cup body 12 is preferably formed in the shape of a generally tapered cylinder, and is preferably formed from a durable plastic material, such as polypropylene. The cup body 12 includes an upper section 16 having threads 18 formed circumferentially therearound to threadably receive a lid assembly 20 thereon.

The lid assembly 20, in accordance with a preferred modality of the present invention, is a composite assembly made up of several component parts which will be briefly listed here, and which will be described in further detail hereinbelow, along with the structural interrelationship thereof.

THE LID ASSEMBLY

Figure 4:
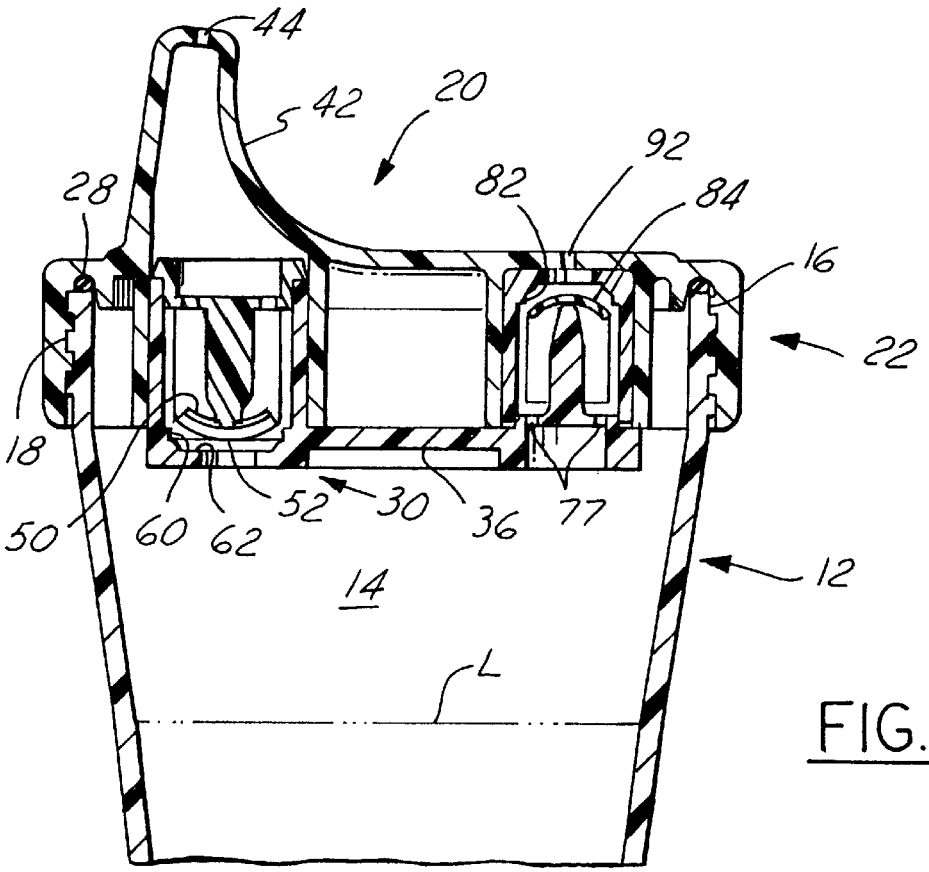
FIG. 4 is a partially broken away cross-sectional side view of the automatically sealing cup in accordance with the present invention, taken along the line 4—4 in FIG. 2, and showing the concave configuration of the diaphragm members during a time that a user is drinking from the cup.
Figure 5:
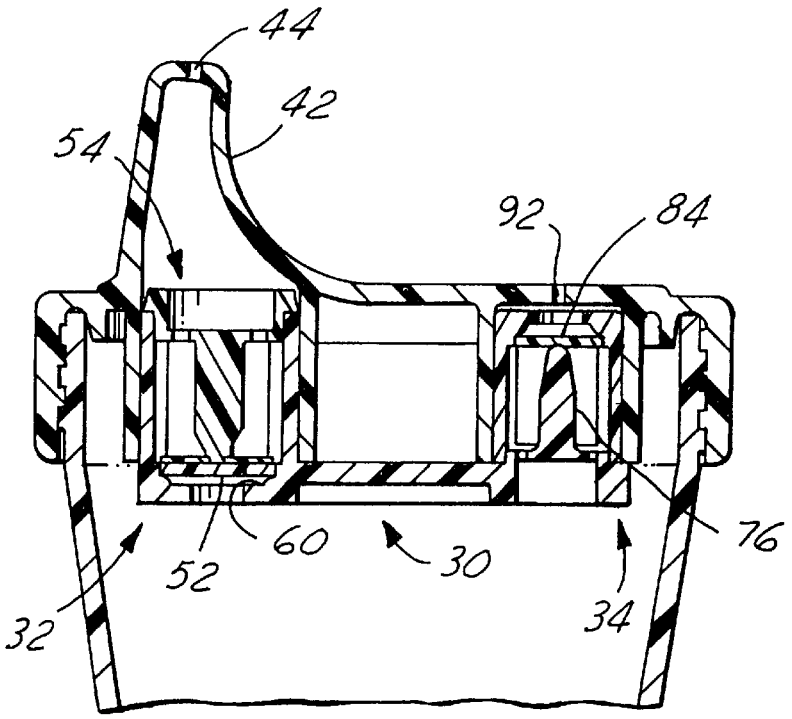
FIG. 5 is a partially broken away cross-sectional view similar to FIG. 4, but showing the substantially planar configuration of the diaphragm members when a user is not drinking from the cup.
Figure 6:
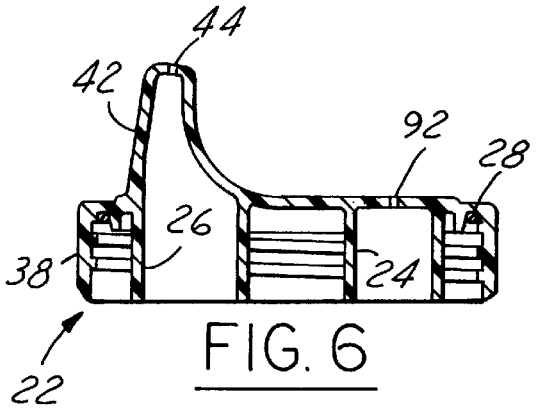
FIG. 6 is a cross-sectional side view of a lid casing for the cup in accordance with the present invention.

The lid assembly 20 includes a lid casing 22 which serves as a main body thereof (see FIGS. 4 through 6). The lid casing 22 has a substantially cylindrical inlet passage 24 and a substantially cylindrical outlet passage 26 formed integrally therein on the lower surface thereof. The lid assembly 20 preferably also includes an annular rubber or elastomeric gasket 28 fitted into the lid casing 22 for compressibly contacting the upper section 16 of the cup body 12 when the lid assembly 20 is threadably installed thereon, to thereby form a fluid-tight seal therebetween (see FIGS. 4 and 5).

The lid assembly 20 further includes a compound valve assembly 30 which fits into the underside of the lid casing 22. The compound valve assembly 30 includes an outlet valve 32, received by the outlet passage 26, and an inlet valve 34 received by the inlet passage 24. The outlet and inlet valves 32, 34 are preferably interconnected by a connector bar 36 whereby both valves can be installed and removed from the lid casing 22 simultaneously. Advantageously, according to the present invention, each of the outlet and inlet valves 32, 34 operate on a resilient diaphragm principle, which will be detailed hereinbelow.

THE LID CASING

As noted, and as shown in FIG. 6, the lid assembly 20 includes a lid casing 22 which serves as a main body thereof As mentioned, the lid casing 22 is preferably formned from a durable plastic material such as polyethylene or polypropylene. The lid casing 22 has a substantially cylindrical inlet passage 24 and a substantially cylindrical outlet passage 26 formed integrally therein on the lower surface thereof. The lid casing 22 also includes a cylindrical collar 38 extending therearound. The lid casing 22 has internal threads 40 formed inside the cylindrical collar 38 to threadably engage and intermesh with the external threads 18 of the cup body 12 for screwing the lid assembly 20 thereon. Preferably, the cylindrical collar 38 is knurled on an outer surface thereof to provide gripping as an aid to threading the lid casing 22 onto and off from the cup body 12. The lid casing 22 further includes an integrally molded spout 42, having one or more outlet holes 44 formed therethrough at the uppermost extension thereof, to allow liquid to pass outwardly therefrom. The lid casing 22 further has an orifice 92 located remote from the spout 42 for allowing air to enter therethrough into the cup.

THE OUTLET VALVE

As shown in FIGS. 4 and 5, the compound valve assembly 30 forms a subassembly of, and a part of, the lid assembly 20. The compound valve assembly 30, as previously noted, includes an outlet valve 32 and an inlet valve 34, which are interconnected by the connector bar 36. The outlet and inlet valves 32, 34 are constructed substantially similarly to one another, but are oriented in a mutually inverted relationship because of the different directions of flow therethrough.

As illustrated in FIGS. 7A through 7D, a compound valve member 46 is a part of the compound valve assembly 30, and includes parts of both the inlet and outlet valves 34, 32. The connector bar 36, which connects the outlet valve 32 to the inlet valve 34, is also part of the compound valve member 46.

The compound valve member 46 includes a generally barrel-shaped first cage member 48 which is open at the top and bottom thereof. The first cage member 48 provides a housing for the outlet valve 32 and its associated valve components: a flexible outer retainer washer 50, a first diaphragm member 52, and a locating member 54 (see FIGS. 8A through 10B). The first cage member 48 of the compound valve member 46 is shown on the left thereof in FIGS. 4, 5, and 7B, and fits snugly into the outlet passage 26 of the lid casing 22, as shown in FIGS. 4 and 5. The first cage member 48 may be constructed to friction fit or snap into the outlet passage 26, or may be glued or welded therein or otherwise affixed thereto. The first cage member 48 of the compound valve member 46, preferably, has a pair of optional openings 56, 58 formed in the sides thereof to promote fluid flow therethrough (see FIG. 7C). The first cage member 48 also has a circular outlet seat 60 formed inside the bottom thereof, to receive the first diaphragm member 52 therein. The first cage member 48 further includes an opening 62*a* defined by an annular internal flange 62. The internal flange 62 extends radially inwardly from, and below, the outlet seat 60 to prevent the first diaphragm member 52 from moving downwardly therepast.

The flexible outer retainer washer 50 fits on top of the first diaphragm member 52, and acts as a resilient stiffener to help keep the first diaphragm member flatly abutting the outlet seat 60 in the absence of a predetermined level of differential fluid pressure acting thereon. The flexible outer retainer washer 50 is preferably formed of resilient polypropylene. The first diaphragm member 52 is preferably formed from a silicone elastomer, and cooperates with the outlet seat 60 to form a selectively fluid-tight seal.

Figure 8B:
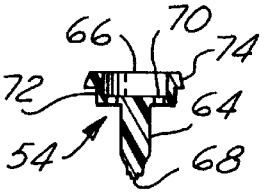
FIG. 8B is a cross-sectional side view of the reinforcing member hereof, taken along the line 8B—8B of FIG. 8A.

The locating member 54 fits into the first cage member 48 of the compound valve member 46, as part of the outlet valve 32. The locating member 54 is generally T-shaped in cross-section, as shown in FIG. 8B, having a first locator post 64 extending downwardly from a perforated circular head 66. The first locator post 64 centrally terminates in a small cylindrical projection 68, at the lowermost end thereof, which fits engagingly into a central hole 51 formed in the flexible outer retainer washer 50. The head 58 of the locating member 54 is generally circular in shape, and has one or more apertures 70 formed therein to allow fluid flow therethrough. The head 58 includes a right angled shoulder 72 on the side thereof, which is dimensioned to fit inside the top of the first cage member 48 of the compound valve member 46, as shown in FIGS. 4 and 5. A circular external flange 74 extends horizontally outwardly above the shoulder 72, at the top of the head 66 of the locating member 54. The circular external flange 74 acts as a stop to limit the extent to which the locating member can travel downwardly in the first cage member 48. The locating member 54 may be constructed to snap in place in the first cage member 48, may fit therein by friction, or may be glued therein.

The first cage member 48, the flexible outer retainer washer 50, the first diaphragm member 52, and the locating member 54 together make up the outlet valve 32 according to the present invention.

THE INLET VALVE

Figure 7A:
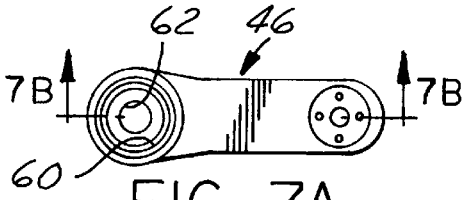
FIG. 7A is a top plan view of a compound valve member in accordance with the present invention.
Figure 7C:
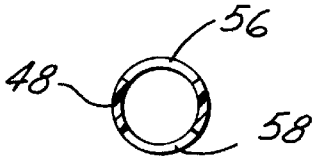
FIG. 7C is a cross-sectional side view of the compound valve member hereof, taken along the line 7C—7C of FIG. 7B.
Figure 7B:
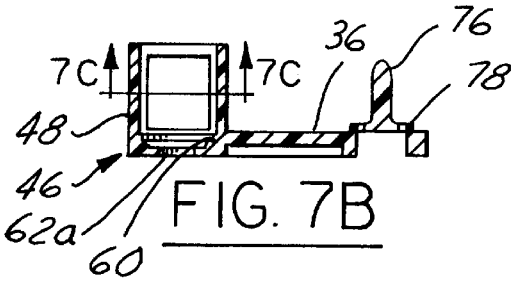
FIG. 7B is a cross-sectional side view of the compound valve member hereof, taken along the line 7B—7B of FIG. 7A.
Figure 7D:
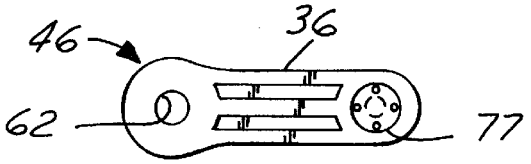
FIG. 7D is a bottom plan view of the compound valve member hereof.
Figure 8A:
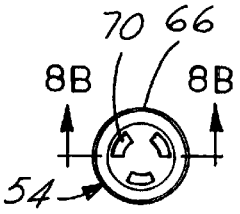
FIG. 8A is a top plan view of a reinforcing member which is a component part of a lid assembly in accordance with the present invention.

The compound valve member 46 also includes a second locator post 76 which is shown on the right in FIG. 7C, and which forms a part of the inlet valve 34. The second locator post 76 is connected to the first cage member 48 by the integrally formed connector bar 36, and extends upwardly therefrom. A raised circular boss 78 extends upwardly on the compound valve member 46, above the level of the connector bar 36 and at the base of the second locator post 76, to provide an aligning surface to line up the second locator post with the inside of a second cage member 80 in assembling the inlet valve 34 (see FIGS. 11A through 12B).

Figure 11A:
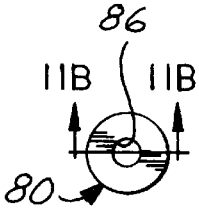
FIG. 11A is a top plan view of a cage member which is another component part of the lid assembly in accordance with the present invention.
Figure 11B:
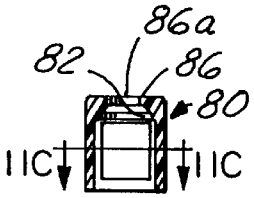
FIG. 11B is a cross-sectional side view of the cage member hereof, taken along the line 11B—11B of FIG. 11A.
Figure 9A:
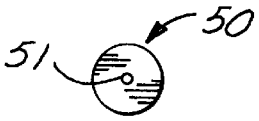
FIG. 9A is a top plan view of an outer retainer in accordance with the present invention.
Figure 11C:
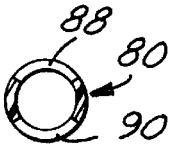
FIG. 11C is a cross-sectional end view of the cage member hereof, taken along the line 11C—11C of FIG. 11B.
Figure 9B:
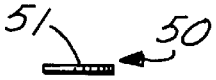
FIG. 9B is a side view of the outer retainer hereof.
Figure 12A:
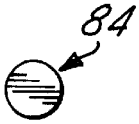
FIG. 12A is a top plan view of a second sealing member in accordance with the present invention.
Figure 10A:
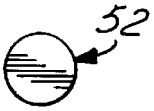
FIG. 10A is a top plan view of a first sealing member in accordance with the present invention.
Figure 12B:
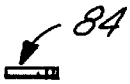
FIG. 12B is a side view of the second sealing member hereof.
Figure 10B:
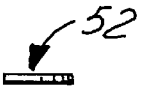
FIG. 10B is a side view of the first sealing member hereof.

The inlet valve 34 also includes the second cage member 80 which is shown separately in FIGS. 11A through 11C. The second cage member 80 is similar to, and shares a similar function with, the first cage member 48 of the compound valve member 46, but is a separate piece which is distinguishable therefrom. The first cage member 48 of the compound valve member 46 forms a part of the outlet valve 32, while by contrast, the second cage member 80 forms a part of the inlet valve 34 hereof.

The second cage member 80 has a generally hollow cylindrical barrel shape which is open at the top and bottom thereof to allow fluid flow therethrough. The second cage member 80 has a circular inlet seat 82 formed therein, at the top thereof, to receive a second diaphragm member 84 therein. The second diaphragm member 84, like the first diaphragm member 52, has a flexibly resilient disc-shape, which is preferably formed of a silicone elastomer. The second cage member 80 further has an opening 86*a* defined by an annular internal flange 86 extending inwardly therein above the inlet seat 52, to retain the second diaphragm member 84 therebelow. The second diaphragm member 84 seats into the inlet seat 82 so as to provide a selectively fluid-tight seal therebetween. The second cage member 80 is dimensioned to fit snugly into the inlet passage 24 of the lid casing, and is attached thereto by gluing, welding, or a frictional or snap-fit connection, or by other suitable attachment means. Preferably, the second cage member 80 has a pair of optional openings 88,90 formed in the sides thereof to promote fluid flow therethrough (see FIG. 11C).

The second cage member 80, the second diaphragm member 84, and the second locator post 76 of the compound valve member 46, together, make up the inlet valve 34 in accordance with the present invention.

ASSEMBLING THE LID ASSEMBLY

In assembling the lid assembly 20 according to the preferred modality of the present invention, the first diaphragm member 52 is placed into the outlet seat 60 formed in the bottom of the first cage member 48 of the compound valve member 46. Then, the flexible outer retainer washer 50 is mounted onto the first locator post 64 by placing the cylindrical projection 68, at the lowermost end of the locator post, into the central hole 51 in the center of the flexible outer retainer washer 50. The locating member 54, with the flexible outer retainer washer 50 attached thereto, is then placed into the first cage member 48 of the compound valve member 46, with the flexible outer retainer washer 50 resting directly on top of the first diaphragm member 52, as shown. The second diaphragm member 84 is then placed into the inlet seat 82 in the top of the second cage member 80, and the second cage member is then placed onto the raised boss 78 of the compound valve member 46, so that the second locator post 76 contacts the second diaphragm member 84, as shown. This completes assembly of the compound valve assembly 30, which is a subassembly of the lid assembly 20. The compound valve assembly 30 is then installed in the lid casing 22, with the outlet valve 32 thereof sealingly fitting into the outlet passage 26 of the lid casing, and the inlet valve 54 thereof sealingly fitting into the inlet passage 24. As previously discussed, the compound valve assembly 30 is attached to the lid casing 22 by any suitable attachment means.

FUNCTIONING OF THE VALVES

In operation, each of the first and second diaphragm members 52, 84 are seated into their respective outlet and inlet seats 60, 82 and located thereat via the first and second locator posts 64, 76, respectively. In this configuration, the first and second diaphragm members 52, 84 sealingly abut their respective outlet and inlet seats 60, 82. However, when a predetermined level of fluid pressure differential across the first diaphragm member occurs, then the first diaphragm member concavely bends away from its outlet seat, as the first locator post prevents the center of the first diaphragm member from flexing. Accordingly, fluid is enabled to flow therethrough out of the cup. As fluid dispenses out of the cup, the air pressure inside the cup reduces below atmospheric pressure. Accordingly, a second predetermined level of fluid pressure differential across the second diaphragm member occurs. As a result, the second diaphragm member concavely bends away from the inlet seat, as the second locator post prevents the center of the second diaphragm member from flexing. Accordingly, air is enabled to flow therethrough into the cup.

The predetermined level of pressure differential across the inlet valve to cause the second diaphragm member to unseat may be small, in that the hydraulic pressure exerted by liquid in the cup is in a direction to seat the second diaphragm member on its inlet seat and is applied at the low pressure side of the pressure differential across the second diaphragm member. In contradistinction, in that the hydraulic pressure exerted by liquid in the cup is in a direction to unseat the first diaphragm member from its outlet seat and is applied at the high pressure side of the pressure differential across the first diaphragm member, the predetermined level of pressure differential across the outlet valve is preferably at least equal to the anticipated maximum hydraulic pressure of the liquid in the cup acting on the first diaphragm member when the cup is in an inverted orientation, and further is at a value which is easily and comfortably attained by a person sucking on the spout with his or her mouth during the act of drinking.

As illustrated in FIGS. 1 and 4, when a person applies suction to the spout 42, which communicates with the outlet passage 26 through the apertures 70 in the locating member 54, the applied suction concavely flexes both the flexible outer retainer washer 50 and the first diaphragm member 52 away from the outlet seat 60, and permits liquid L from the interior 14 of the cup 10 to flow past the first diaphragm member and out of the spout 42. At the same time, lowered pressure in the interior of the cup 10 causes air outside of the cup 10 to press inwardly on the second diaphragm member 84 in the inlet passage 24, concavely flexing the second diaphragm member away from the inlet seat 82, and allowing air to pass through an orifice 92 formed in the top of the lid casing 22 above the inlet passage 24. This air then passes through the second cage member 80, via a series of perforations 77 formed through the raised boss 78 of the compound valve member 46 at the base of the locating post 76, and then passes into the hollow interior 14 of the cup body 12 to equalize pressure inside and outside the cup 10.

When drinking stops, as illustrated in FIG. 5, the natural resiliency of the flexible outer retainer washer 50 in concert with its abutting first diaphragm member 52, as well as the second diaphragm member 84 bias back into their seated sealing positions. The first diaphragm member 52 fits sealingly into the outlet seat 60 formed in the first cage member 48 of the outlet valve 32, to prevent spillage from the cup through the outlet passage 26, and the second diaphragm member 84 fits sealingly into the inlet seat 82 formed in the cage member 80 of the inlet valve 34, to prevent spillage from the cup 10 at the inlet passage 24.

Although the present invention has been described herein with respect to a preferred embodiment thereof, the foregoing description is intended to be illustrative, and not restrictive. Those skilled in the art will realize that many modifications of the preferred embodiment could be made which would be operable. All such modifications which are within the scope of the appended claims are intended to be within the scope and spirit of the present invention.

What is claimed is:

1. A self-sealing drinking container, comprising:

a cup body having a hollow interior for holding and dispensing a liquid;

a lid assembly sealingly engageable with said cup body, said lid assembly having an inlet and an outlet;

outlet valve means located in said outlet for selectively sealing said outlet, said outlet valve means comprising: an outlet seat;

a flexibly resilient first diaphragm member seated at said outlet seat said first diaphragm member being free of perforation and first location means for locating said first diaphragm member at said outlet seat; and inlet valve means located in said inlet for selectively sealing said inlet, said inlet valve means comprising: an inlet seat;

a flexibly resilient second diaphragm member seated at said inlet seat, said second diaphragm member being free of perforation; and second location means for locating said second diaphragm member at said inlet seat;

wherein said first diaphragm member is sealingly seated at said outlet seat below a first predetermined level of fluid pressure differential applied thereacross, and wherein said second diaphragm member is sealiny seated at said inlet seat below a second predetermined level of fluid pressure differential applied thereacross; and wherein said first diaphragm member resiliently bends so as to unseal with respect to said outlet seat above said first predetermined fluid pressure differential applied thereacross, and wherein said second diaphragm member resiliently bends so as to unseal with respect to said inlet seat above said second predetermined level of fluid differential pressure applied thereacross;

wherein said first location means comprises a first post in stationary connection to said outlet valve means which centrally and nonpiercingly abuts said first diaphragm member; and wherein said second location means comprises a second post in stationary connection to said inlet valve means which centrally and nonpiercingly abuts said second diaphragm member.

2. The drinking container of claim 1, wherein said outlet valve means regulates liquid flow out of said cup body, and wherein said inlet valve means regulates air flow into said cup body responsive to said liquid flow out of said cup body.

3. The drinking container of claim 2, wherein said outlet valve means further comprises a resilient circular outer retainer located between said first post and said first diaphragm member.

4. The drinking container of claim 3, wherein said first and second valve means further comprise:

a first cage member located in said outlet, said outlet seat being formed in said first cage member; and a second cage member located in said inlet, said inlet seat being formed in said second cage member.

5. The drinking container of claim 4, wherein said outlet further comprises a spout having at least one aperture formed in said lid assembly which communicates with said outlet valve means; and wherein said inlet further comprises an orifice formed in said lid assembly which communicates with said inlet valve means.

6. The drinking container of claim 5, wherein said first and second cage members are mutually connected together to thereby form a compound valve assembly which sealingly interfits with said lid assembly.

7. The drinking container of claim 5, wherein said outlet and inlet valve means further comprise an annular flange adjacent said first and second inlet seats, respectively.

8. In an automatically sealing drinking container having a cup body, a lid sealingly engageable with the cup body, outlet valve means for regulating liquid flow out of said cup body in response to a first predetermined level of fluid pressure differential applied thereacross, and inlet valve means for regulating air entry into said cup body in response to a second predetermined level of fluid pressure differential applied thereacross, the improvement comprising:

outlet valve means located in said outlet for selectively sealing said outlet, said outlet valve means comprising an outlet seat;

a flexibly resilient first diaphragm member seated at said outlet seat; and first location means for locating said first diaphragm member at said outlet seat; and inlet valve means located in said inlet for selectively sealing said inlet, said inlet valve means comprising.

an inlet seat;

a flexibly resilient second diaphragm member seated at said inlet seat; and second location means for locating said second diaphragm member at said inlet seat;

wherein said first diaphragm member is sealingly seated at said outlet seat below a first predetermined level of fluid pressure differential applied thereacross, and wherein said second diaphragm member is sealiny seated at said inlet seat below a second predetermined level of fluid pressure differential applied thereacross; and wherein said first diaphragm member resiliently bends so as to unseal with respect to said outlet seat above said first predetermined fluid pressure differential applied thereacross, and wherein said second diaphragm member resiliently bends so as to unseal with respect to said inlet seat above said second predetermined level of fluid differential pressure applied thereacross;

wherein said outlet valve means further comprises a resilient circular outer retainer located between said first post and said first diaphragm member.

9. A valve system for a self-sealing drinking container having a cup body having a hollow interior for holding and dispensing a liquid and a lid assembly sealiny engageable with said cup body, the lid assembly having an inlet and an outlet, said valve system comprising:

outlet valve means for being located in an outlet of a cup for selectively sealing the outlet, said outlet valve means comprising an outlet seat;

a flexibly resilient first diaphragm member seated at said outlet seat said first diaphragm being free of perforation; and first location means for locating said first diaphragm member at said outlet seat; and inlet valve means for being located in an inlet of a cup for selectively sealing the inlet, said inlet valve means comprising:

an inlet seat;

a flexibly resilient second diaphragm member seated at said inlet seat, said second diaphragm being free of perforation; and second location means for locating said second diaphragm member at said inlet seat;

wherein said first diaphragm member is sealingly seated at said outlet seat below a first predetermined level of fluid pressure differential applied thereacross, and wherein said second diaphragm member is sealingly seated at said inlet seat below a second predetermined level of fluid pressure differential applied thereacross; and wherein said first diaphragm member resiliently bends so as to unseal with respect to said outlet seat above said first predetermined fluid pressure differential applied thereacross, and wherein said second diaphragm member resiliently bends so as to unseal with respect to said inlet seat above said second predetermined level of fluid differential pressure applied thereacross;

wherein said first location means comprises a first post in stationary connection to said outlet valve means which centrally and nonpiercingly abuts said first diaphragm member; and wherein said second location means comprises a second post in stationary connection to said inlet valve means which centrally and nonpiercingly abuts said second diaphragm member.

10. The valve system of claim 9, wherein said outlet valve means further comprises a resilient circular outer retainer located between said first post and said first diaphragm member.

11. The valve system of claim 10, wherein said first and second valve means further comprise:

a first cage member located in said outlet, said outlet seat being formed in said first cage member; and a second cage member located in said inlet, said inlet seat being formed in said second cage member.

12. The valve system of claim 11, wherein said first and second cage members are mutually connected together to thereby form a compound valve assembly which sealingly interfits with said lid assembly.

13. The valve system of claim 12, wherein said outlet and inlet valve means further comprise an annular flange adjacent said first and second inlet seats, respectively.

14. In an automatically sealing drinking container having a cup body, a lid sealingly engageable with the cup body, outlet valve means for regulating liquid flow out of said cup body in response to a first predetermined level of fluid pressure differential applied thereacross, and inlet valve means for regulating air entry into said cup body in response to a second predetermined level of fluid pressure differential applied thereacross, the improvement comprising:

outlet valve means located in said outlet for selectively sealing said outlet, said outlet valve means comprising an outlet seat;

a flexibly resilient first diaphragm member seated at said outlet seat; and first location means for locating said first diaphragm member at said outlet seat; and inlet valve means located in said inlet for selectively sealing said inlet, said inlet valve means comprising inlet seat;

a flexibly resilient second diaphragm member seated at said inlet seat; and second location means for locating said second diaphragm member at said inlet seat;

wherein said first diaphragm member is sealiny seated at said outlet seat below a first predetermined level of fluid pressure differential applied thereacross, and wherein said second diaphragm member is sealingly seated at said inlet seat below a second predetermined level of fluid pressure differential applied thereacross; and wherein said first diaphragm member resiliently bends so as to unseal with respect to said outlet seat above said first predetermined fluid pressure differential applied thereacross, and wherein said second diaphragm member resiliently bends so as to unseal with respect to said inlet seat above said second predetermined level of fluid differential pressure applied thereacross;

wherein said first and second valve means further comprise:

a first cage member located in said outlet, said outlet seat being formed in said first cage member; and a second cage member located in said inlet, said inlet seat being formed in said second cage member;

wherein said first and second cage members are mutually connected together to thereby form a compound valve assembly which sealingly interfits with said lid assembly.

15. The drinking container of claim 14, wherein said outlet and inlet valve means further comprise an annular flange adjacent said first and second inlet seats, respectively.

* * * * *